US011845641B1

(12) United States Patent
Watts

(10) Patent No.: US 11,845,641 B1
(45) Date of Patent: Dec. 19, 2023

(54) FLAT FLOOR JACK

(71) Applicant: Titus Gadwin Watts, San Francisco, CA (US)

(72) Inventor: Titus Gadwin Watts, San Francisco, CA (US)

( * ) Notice: Subject to any disclaimer, the term of this patent is extended or adjusted under 35 U.S.C. 154(b) by 0 days.

(21) Appl. No.: 17/373,468

(22) Filed: Jul. 12, 2021

Related U.S. Application Data

(60) Provisional application No. 63/050,510, filed on Jul. 10, 2020.

(51) Int. Cl.
*B66F 5/04* (2006.01)

(52) U.S. Cl.
CPC ..... *B66F 5/04* (2013.01)

(58) Field of Classification Search
CPC ..... B66F 5/04; B66F 5/00; B66F 5/02; B66F 7/00; B66F 7/04; B66F 9/00; B60B 27/0005; B60B 35/18
USPC ..... 254/2 R, 3 B, 4 B, 7 B, 9 B
See application file for complete search history.

(56) References Cited

U.S. PATENT DOCUMENTS 1,880,150 A * 9/1932 Nilson ..... B66F 5/02 254/6 B
3,880,481 A * 4/1975 George ..... B66F 9/07518 384/513
4,334,667 A * 6/1982 Fox ..... B66F 5/04 251/251
2005/0127629 A1* 6/2005 Nelson ..... A63C 17/01 280/87.042
2011/0193035 A1* 8/2011 Kania ..... B66F 5/04 254/1
2016/0107868 A1* 4/2016 Arzouman ..... B66F 3/30 254/14

* cited by examiner

*Primary Examiner* — Don M Anderson
*Assistant Examiner* — Caleb Andrew Holizna
(74) *Attorney, Agent, or Firm* — Plager Schack LLP; Mark H. Plager; Michael J. O'Brien

(57) ABSTRACT

A flat floor jack is configured to be maneuverable and manage a heavy load. The flat floor jack has a handle attached to a first side wall and a second side wall. A lifting arm is rotatably coupled to the first side wall and the second side wall. A hydraulic cylinder is joined to the first side panel and the second side panel. A first axel is arranged through the first side wall and the second side wall and attached to a first roller and a second roller. A second axel is arranged through the first side wall and the second side wall and attached to a third roller and a fourth roller. Each roller has a roller bearing assembly that has hundreds of small spheres arranged adjacent to one another such that weight from the roller is distributed among the hundreds of small spheres.

1 Claim, 4 Drawing Sheets

FLAT FLOOR JACK

RELATED APPLICATION

This application claims priority to provisional patent application U.S. Ser. No. 63/050,510 filed on Jul. 10, 2020, the entire contents of which is herein incorporated by reference.

BACKGROUND

The embodiments herein relate generally to tools used for lifting other items.

Prior to embodiments of the disclosed invention, most floor jacks used in mechanics were heavy and hard to handle. One was not able to balance a jack very well because the handles were on the side of the jack. Handles that were located on the top were made from plastic and were only found on smaller jacks. These small handles could not handle the weight of large jacks

SUMMARY

A flat floor jack is configured to be maneuverable and manage a heavy load. The flat floor jack has a handle attached to a first side wall and a second side wall. A lifting arm is rotatably coupled to the first side wall and the second side wall. A hydraulic cylinder is joined to the first side panel and the second side panel. A first axel is arranged through the first side wall and the second side wall and attached to a first roller and a second roller. A second axel is arranged through the first side wall and the second side wall and attached to a third roller and a fourth roller. Each roller has a roller bearing assembly that has hundreds of small spheres arranged adjacent to one another such that weight from the roller is distributed among the hundreds of small spheres.

In some embodiments, a handle is connected to the hydraulic cylinder. A user can engage the handle to compress a hydraulic fluid in the hydraulic cylinder engages a linkage assembly which raises the lifting arm.

In some embodiments, a release valve is connected to the hydraulic cylinder. A user can engage the release valve releases the pressure from the hydraulic cylinder which engages the linkage assembly to lower the lifting arm.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 2:
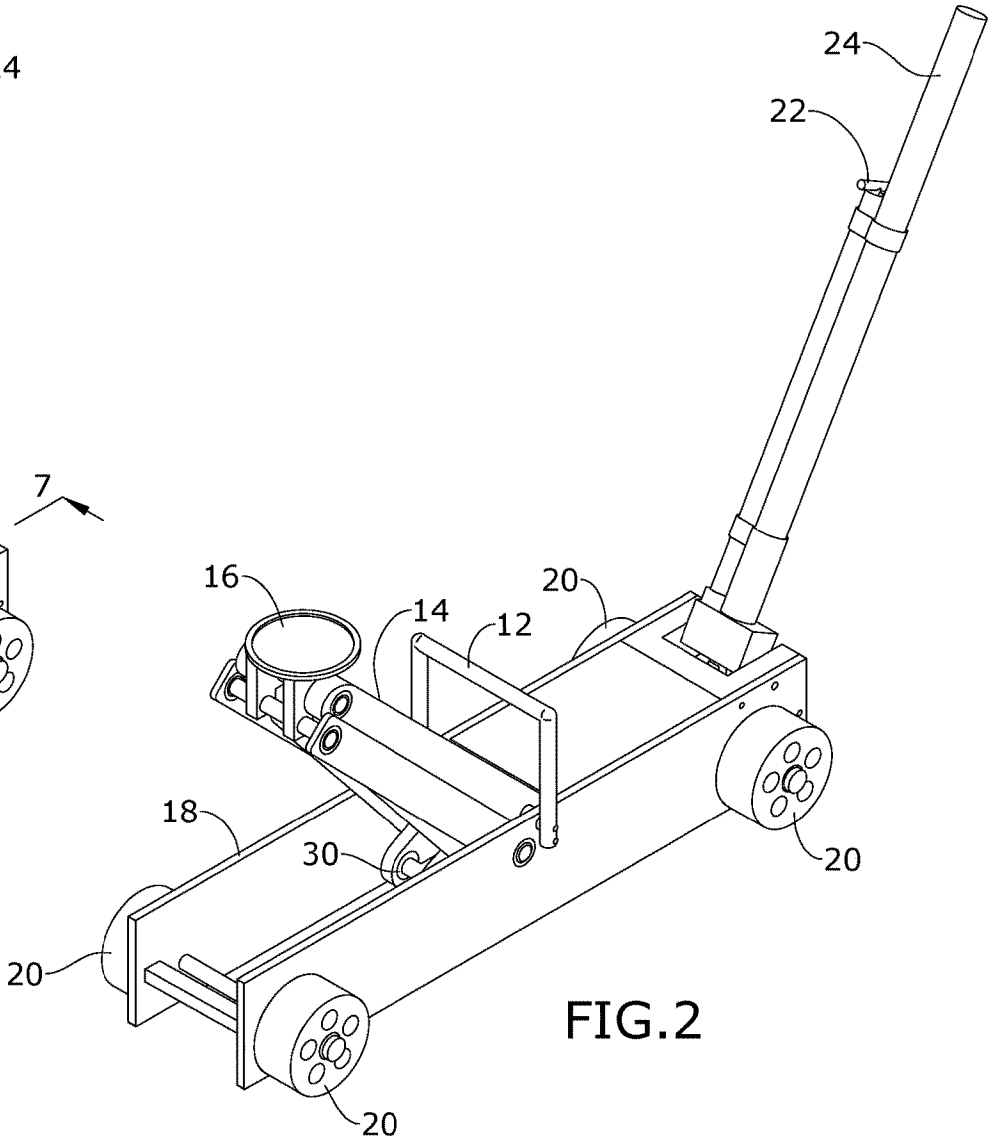
FIG. 2 shows a front perspective view of one embodiment of the present invention with the lifting arm shown in the lowered position.
Figure 1:
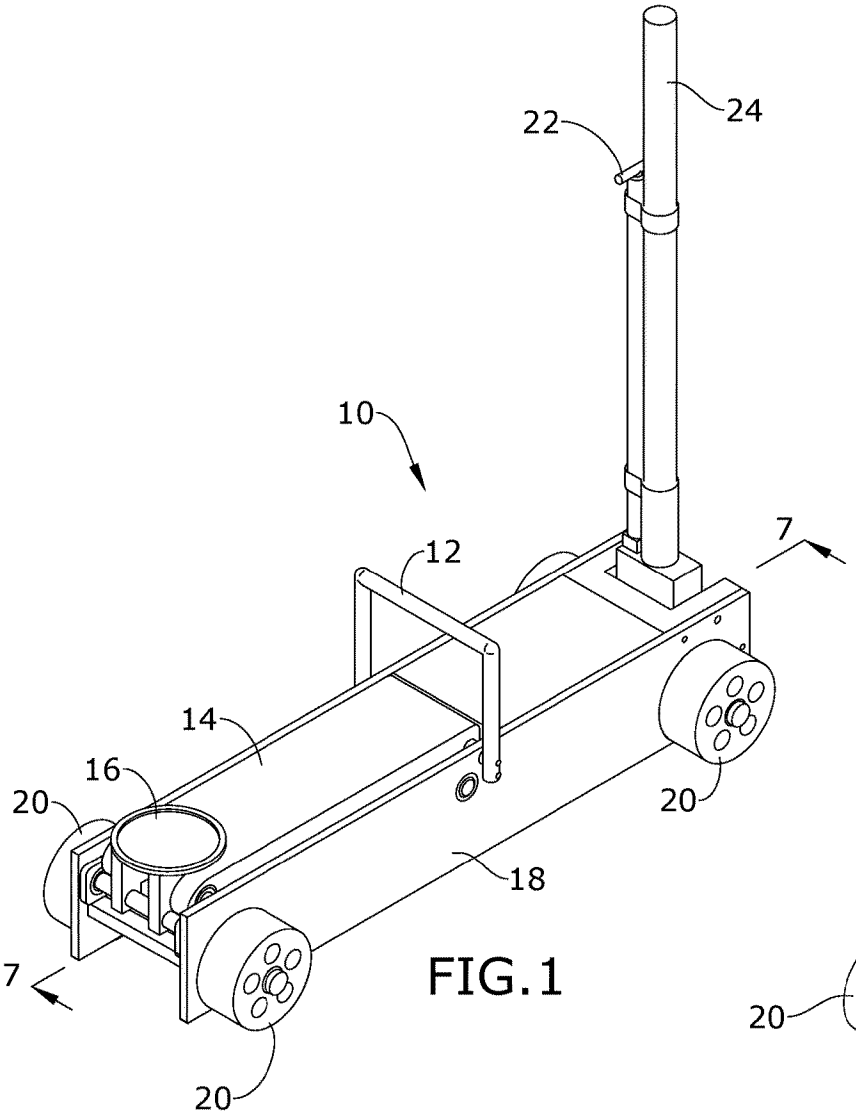
FIG. 1 shows a front perspective view of one embodiment of the present invention with the lifting arm shown in the lowered position.
Figure 3:
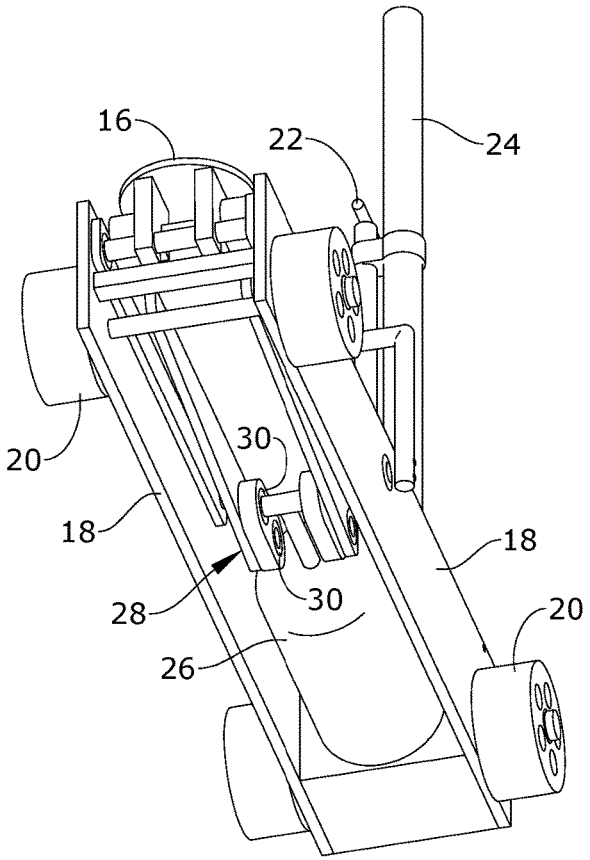
FIG. 3 shows a bottom perspective view of one embodiment of the present invention with the lifting arm shown in the lowered position.
Figure 4:
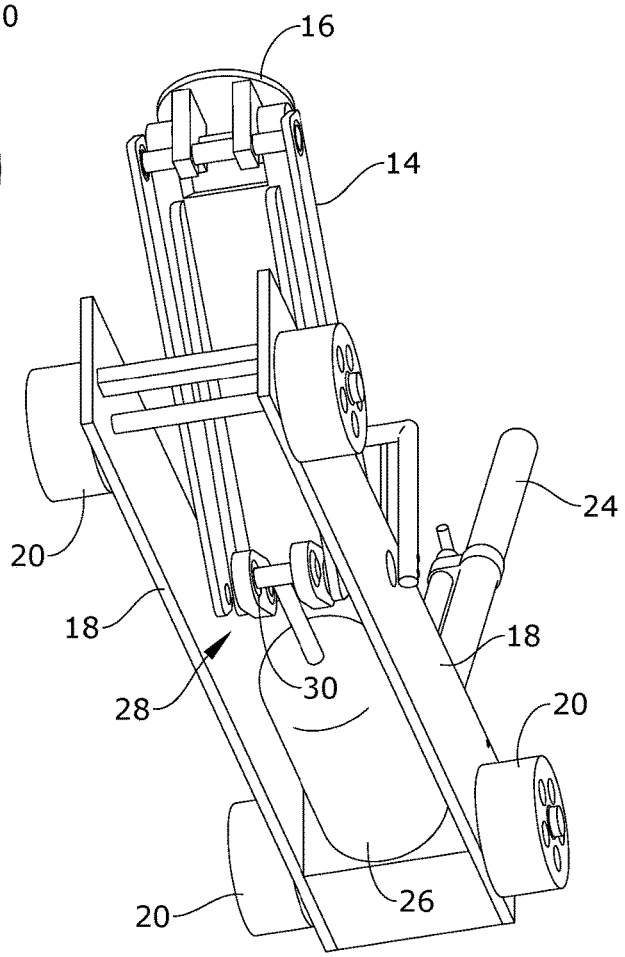
FIG. 4 shows a bottom perspective view of one embodiment of the present invention with the lifting arm shown in the lowered position.
Figure 5:
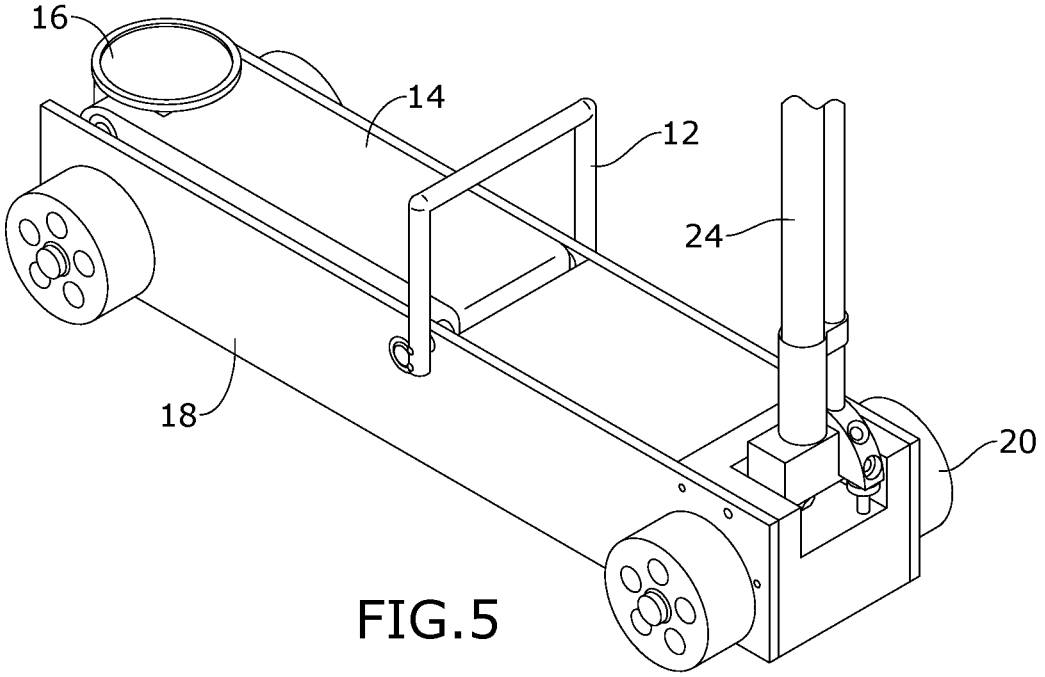
FIG. 5 shows a rear perspective view of one embodiment of the present invention with the lifting arm shown in the lowered position.
Figure 6:
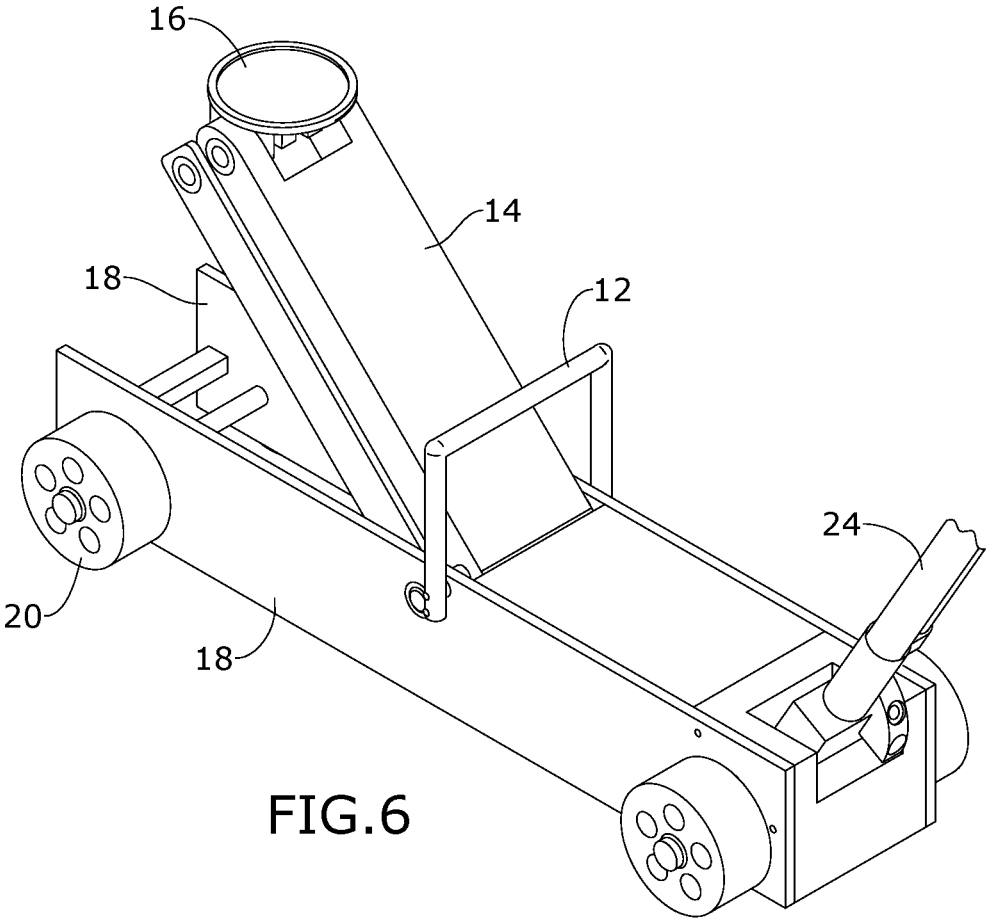
FIG. 6 shows a rear perspective view of one embodiment of the present invention with the lifting arm shown in the lowered position.
Figure 7:
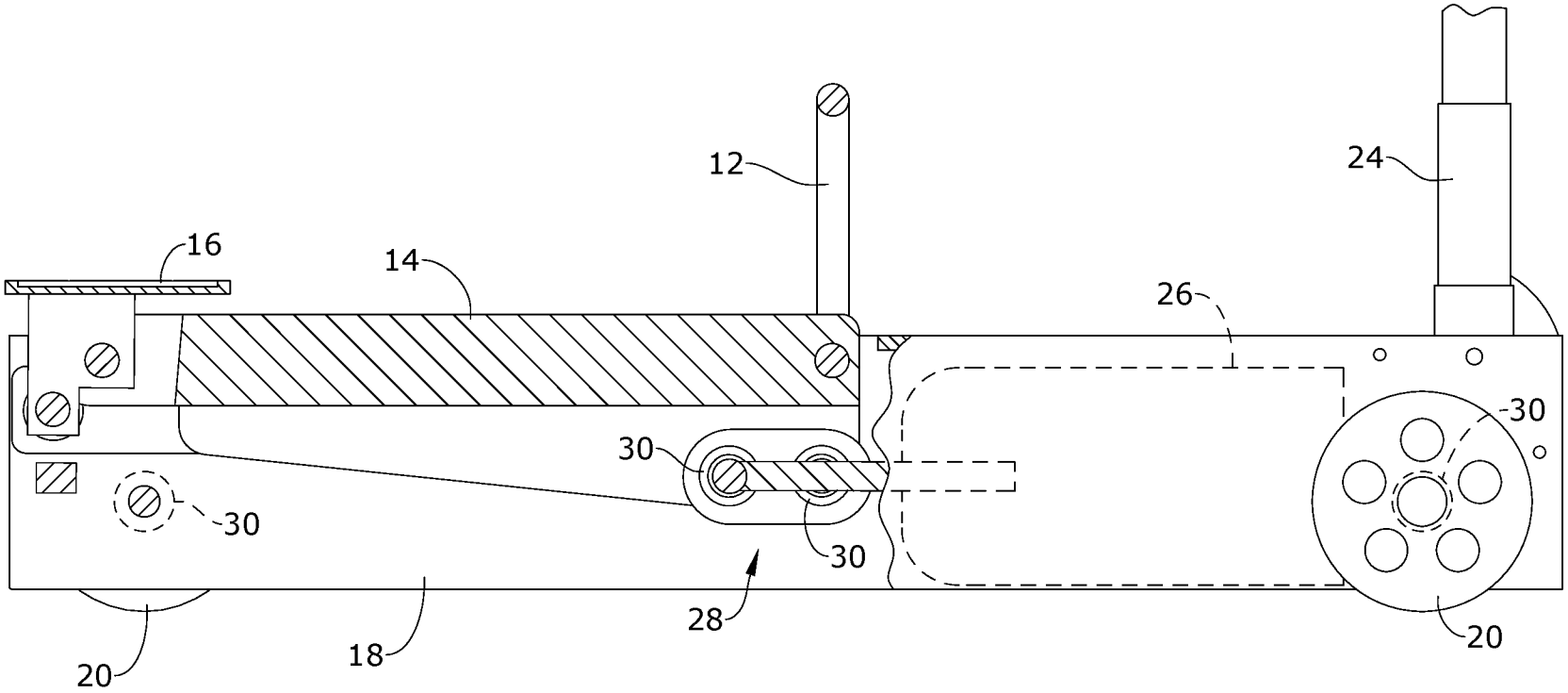
FIG. 7 shows a section view of one embodiment of the present invention taken along line 1-1 in FIG. 1.

By way of example, and referring to FIG. 1, one embodiment of a flat floor jack 10 further comprises a handle 12 attached to a first side wall 18 and a second side wall 18. The first side wall 18 and the second side wall 18 are rotatably coupled to a lifting arm 14. The lifting arm 14 is attached to a saddle 16.

The first side wall 18 and the second side wall 18 are attached to a first roller 20 and a second roller 20 with a first axel. The first side wall 18 and the second side wall 18 are attached to a third roller 20 and a fourth roller 20 with a second axel.

A release valve 22 and a handle 24 are connected to a hydraulic cylinder 26. The hydraulic cylinder 26 is joined to the first side panel 18 and the second side panel 18. A user can engage the handle to compress a hydraulic fluid in the hydraulic cylinder 26 to engage a linkage assembly 28 which raises the lifting arm 14. Similarly, a user can engage the release valve 22, to release pressure from the hydraulic cylinder 26 which engages the linkage assembly 28 to lower the lifting arm 14.

The primary difficulty in floor jacks is the difficulty of maneuverability. The rollers 20 solve this problem with uniquely arrange roller bearings 30. The roller bearings 30 further comprise hundreds of small spheres arranged adjacent to one another such that weight from the roller 20 is widely distributed among the hundreds of small spheres.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A flat floor jack, configured to be maneuverable and manage a heavy load, the flat floor jack consisting of:

a handle, attached to a first side wall and a second side wall;

a lifting arm, rotatably coupled to the first side wall and the second side wall;

a hydraulic cylinder, joined to the first side wall and the second side wall;

a tube, further comprising a first end and a second end, wherein the first end is attached to a block proximate the hydraulic cylinder, and the tube extends along an exterior of the handle wherein the handle is connected to the hydraulic cylinder; wherein engaging the handle to compress a hydraulic fluid in the hydraulic cylinder engages a linkage assembly which raises the lifting arm a release valve, joined to the second end and the handle;

a first axel, arranged through the first side wall and the second side wall and attached to a first roller and a second roller;

a second axel, arranged through the first side wall and the second side wall and attached to a third roller and a fourth roller;

wherein each roller further comprises a roller bearing assembly that has hundreds of small spheres arranged adjacent to one another such that weight from the roller is distributed among the hundreds of small spheres;

wherein engaging the release valve releases the pressure from the hydraulic cylinder which engages the linkage assembly to lower the lifting arm.

* * * * *